US005500837A

United States Patent [19]

Flury

[11] Patent Number: 5,500,837

[45] Date of Patent: Mar. 19, 1996

[54] WRISTWATCH IN PLASTIC MATERIAL INCLUDING A METALLIC REINFORCING ARMATURE USED AS BASEPLATE

[75] Inventor: Ronald Flury, Lengnau, Switzerland

[73] Assignee: ETA SA Fabriques d'Ebauches, Grenchen, Switzerland

[21] Appl. No.: 492,432

[22] Filed: Jun. 19, 1995

[30] Foreign Application Priority Data

Jun. 30, 1994 [CH] Switzerland ..... 2082/94

[51] Int. Cl.[6] ..... G04B 37/00

[52] U.S. Cl. ..... 368/276; 368/280; 368/300

[58] Field of Search ..... 368/88, 276, 280, 368/281, 282, 294–296, 297–300

[56] References Cited

U.S. PATENT DOCUMENTS

| | | | |
|---|---|---|---|
| 4,496,246 | 1/1985 | Ota et al. . | |
| 4,558,957 | 12/1985 | Mock et al. . | |
| 4,648,722 | 3/1987 | Mock et al. . | |
| 4,727,524 | 2/1988 | Shoji et al. | 368/281 |
| 4,995,023 | 2/1991 | Muller et al. | 368/276 |

FOREIGN PATENT DOCUMENTS

| | | |
|---|---|---|
| 0101663 | 2/1984 | European Pat. Off. . |
| 1363424 | 3/1985 | France . |
| 206981 | 1/1939 | Switzerland . |
| 580294 | 3/1971 | Switzerland . |
| 620081 | 10/1984 | Switzerland . |
| 639812 | 5/1987 | Switzerland . |
| 675339 | 9/1990 | Switzerland . |
| 2085621 | 4/1982 | United Kingdom . |

OTHER PUBLICATIONS

Actes Du Congres Europeen De Chronometrie, "Utilisation De Matieres Synthetiques Dans La Fabrication Des Montres Analogiques", No. 1, 23 Sep. 1988, pp. 129–134.

*Primary Examiner*—Vit W. Miska
*Attorney, Agent, or Firm*—Pollock, Vande Sande & Priddy

[57] ABSTRACT

A ultra-thin wristwatch includes a back cover-caseband and a crystal in plastic material. The case is reinforced by a metallic armature. Such armature, in addition to serving as fastening point for a bracelet, is used as baseplate on which is secured at least one central stud around which pivot the hours and minutes hands.

6 Claims, 6 Drawing Sheets

WRISTWATCH IN PLASTIC MATERIAL INCLUDING A METALLIC REINFORCING ARMATURE USED AS BASEPLATE

FIELD OF THE INVENTION

The present invention concerns an ultra-thin wristwatch including a back cover-caseband and a crystal formed in plastic material, a movement, hands surmounting a dial and a metallic reinforcing armature sunk into the back cover-caseband and serving inter alia as attachment points for a bracelet.

BACKGROUND OF THE INVENTION

Patent document CH-B-675 339 has already proposed a wrist-watch the caseband of which can be constituted of any non-metallic material, natural or synthetic. Such caseband exhibits a cylindrical housing in which a case sheltering a movement is secured by means of a toroidal elastic packing engaged on the one hand in an annular groove of the cylindrical housing and, on the other hand, in a peripheral groove of the case. The caseband is provided with a metallic armature to which a bracelet is brought for attachment.

The summary construction described hereinabove does not suit an ultra-thin watch, that is to say, a watch the thickness of which does not exceed approximately 4 millimeters. In effect, it will be understood that recourse to an independent case sheltering the entire movement, back cover and crystal included, such case having additionally to be secured to the caseband by a toroidal elastic packing, leads to a piece which is necessarily thick. On the other hand, the metallic armature proposed has as a purpose only to withstand the substantial forces exerted on the watch by the various tractions exerted by the bracelet and can in no way at the same time play the role of a baseplate, as such is the case in the present invention which is to be described hereinbelow.

It is not indicated in the document cited hereinabove whether the described arrangement is suitable for a case formed of plastic material into which the metallic element would be sunk by overmoulding of said material. One may nevertheless consider it so if reference is had for example to patent documents CH-B-580 294 and FR-A-1 363 424, which both describe a reinforcing metallic insert sunk into a case injected in plastic material. In these documents, however, the insert in question is not used to retain a bracelet any more than it is used to serve as a base plate for a movement.

SUMMARY OF THE INVENTION

Thus, with the purpose of proposing an ultra-thin wristwatch while taking inspiration from certain techniques forming a part of the state of the art, the present invention is original by the fact that the metallic reinforcing armature serves in addition as a base plate on which is secured at least one central stud around which pivots a cannon pinion bearing the minutes hand, a cannon wheel bearing the hours hand pivoting in turn on said cannon pinion.

BRIEF DESCRIPTION OF THE DRAWINGS

The invention will now be understood upon reading the description which follows illustrated by the drawings showing an embodiment thereof.

DETAILED DESCRIPTION OF THE INVENTION

Figure 1:
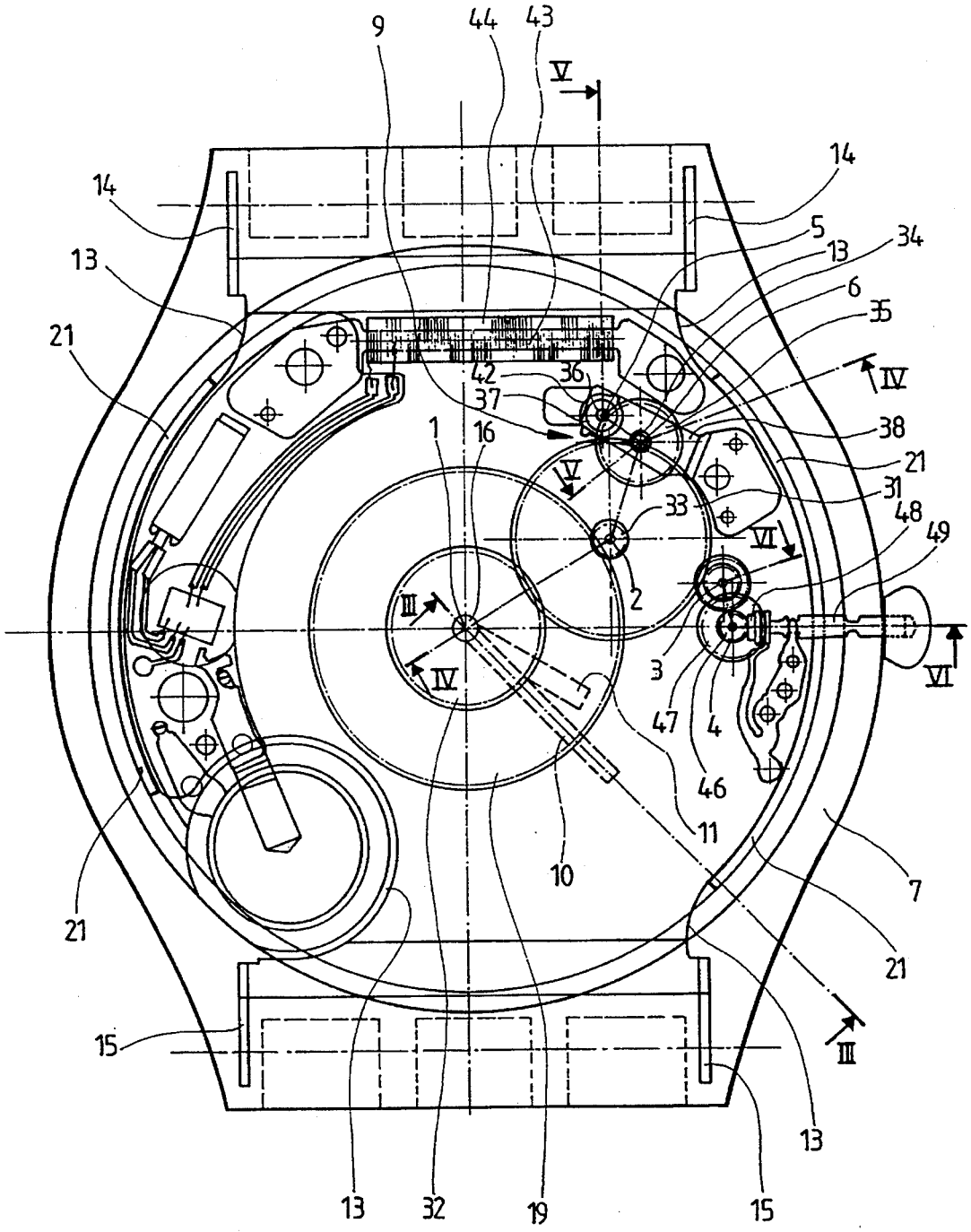
FIG. 1 is a plan view from above of the watch according to the invention in which view the dial has been removed.
Figure 2:
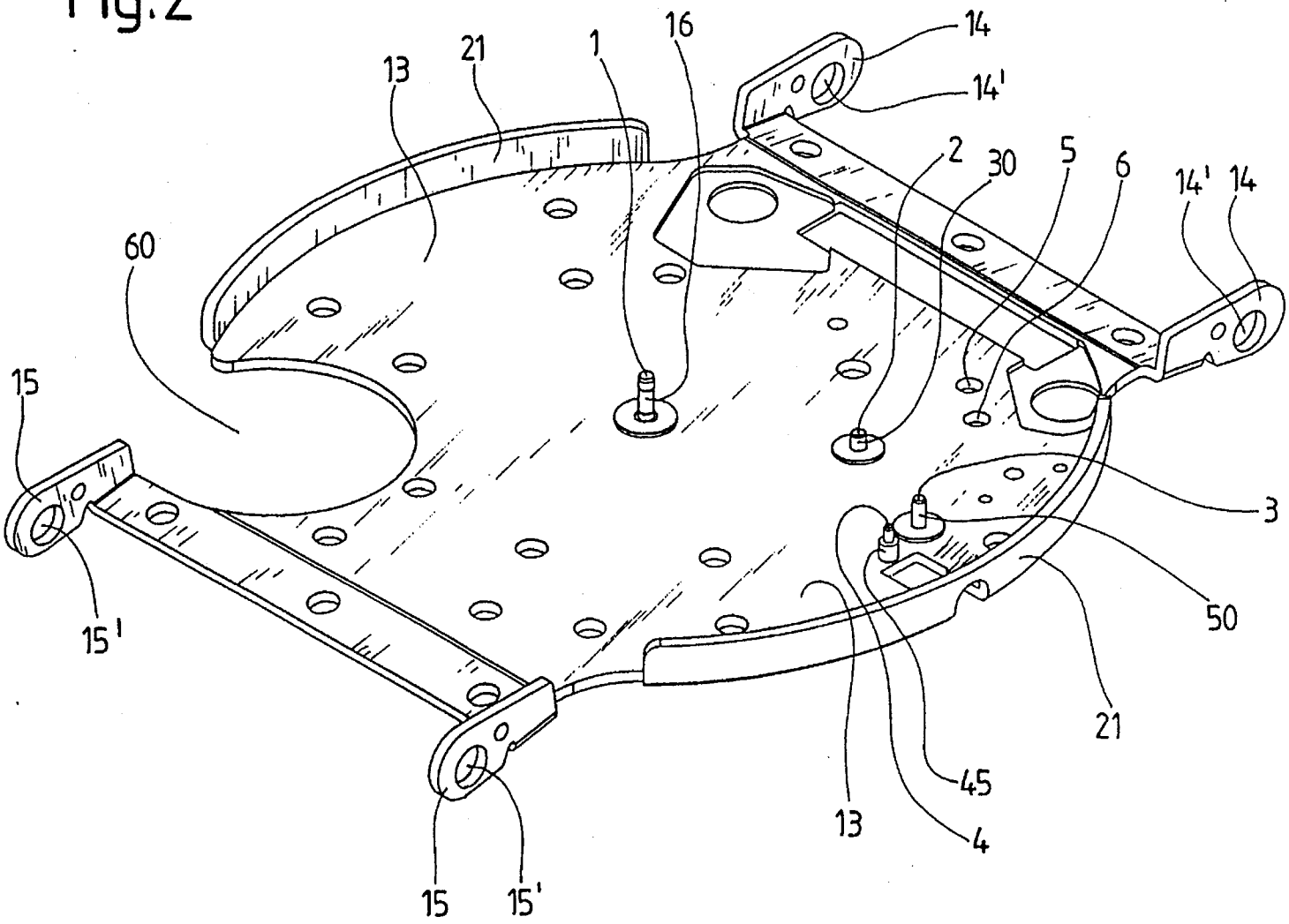
FIG. 2 is a perspective view of the metallic reinforcing armature sunk in the case of the watch of FIG. 1.
Figure 3:
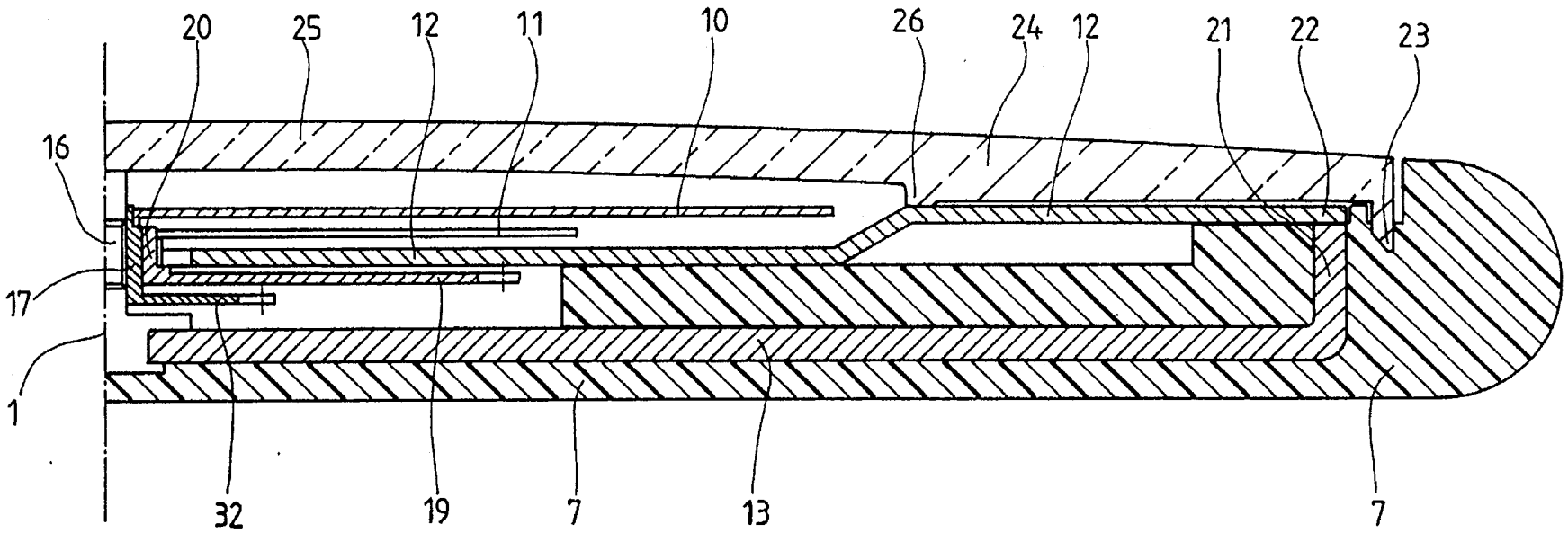
FIG. 3 is a cross-section along line III—III of FIG. 1.

If one refers more specifically to FIG. 1 and FIG. 3, this latter being a cross-section along line III—III of FIG. 1, the ultra-thin wristwatch includes a back cover-caseband 7 and a crystal 8 formed of plastic material. The watch also includes a movement 9 and hands 10, 11 surmounting a dial 12. The watch comprises above all a metallic reinforcing armature 13 sunk into the back cover-caseband 7, such armature serving inter alia as attachment points 14, 15 for a bracelet, not shown. The present invention is noteworthy in the sense that the metallic reinforcing armature 13 further serves as a base plate onto which is secured at least one central stud 16, the axis of which bears reference 1. FIG. 2 shows such armature 13 exhibited in perspective, before it is moulded into the back cover-caseband 7. As is readily seen on FIG. 3, around the central stud 16 pivots a cannon pinion 17 which bears the minutes hand 10. Pivoting in turn on cannon pinion 17, FIG. 3 shows a wheel 19 with pipe 20 which bears the hours hand 11.

Thus, it is understood that armature 13, in addition to serving as reinforcement for the case and bracelet attachment as such was known from the prior art, is additionally used as base plate bearing at least the set of hands indicating the time. Such utilization is novel and is not known from prior time-pieces.

Figure 4:
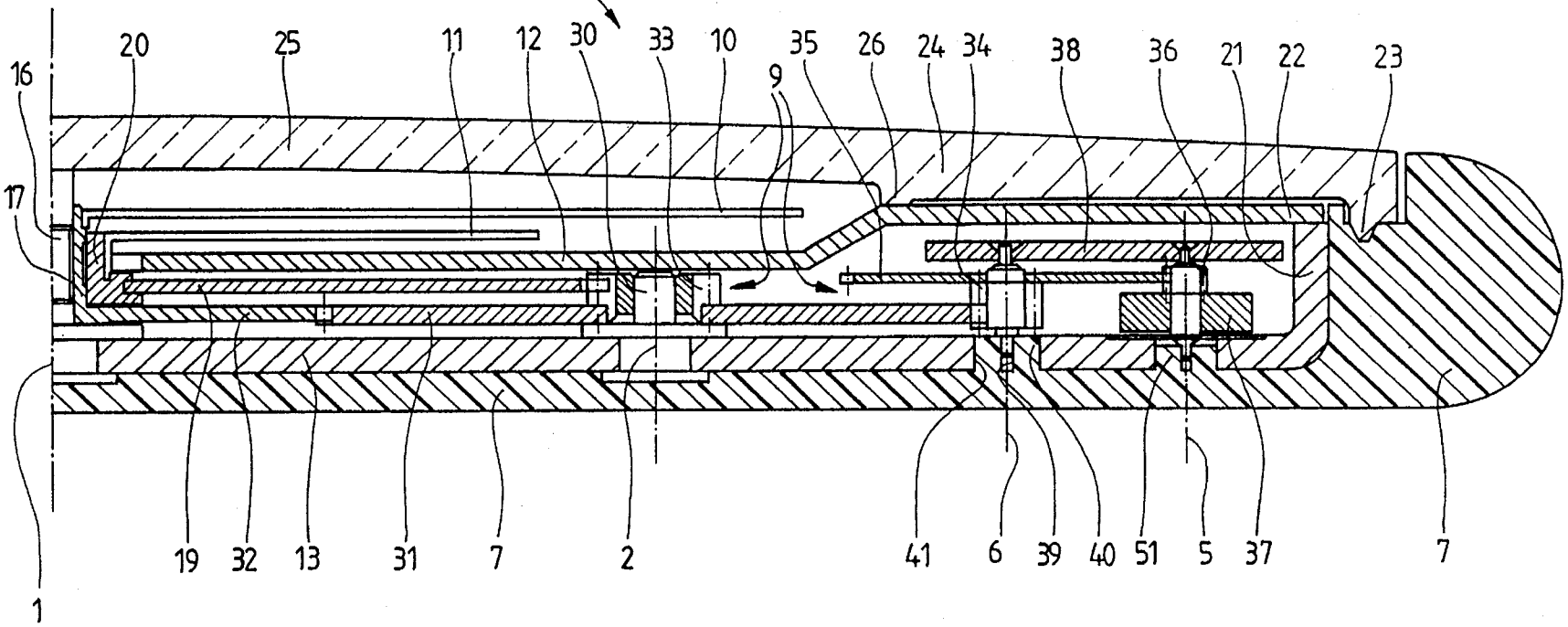
FIG. 4 is a cross-section along line IV—IV of FIG. 1.

If reference is again made to FIG. 2, it is determined that the armature or base plate 13 bears horns 14 and 15 located at 6 o'clock and 12 o'clock arranged to receive in bores 14' and 15' bars which are not shown and around which strands of a bracelet come to be linked. FIG. 2 also shows that the armature 13 includes raised edges 21, here diametrally opposed edges. Such raised edges pursue two purposes, initially that of stiffening armature 13 and next that of serving as support, at least partially, for dial 12. If reference is had to FIGS. 3, 4 and 6, it is seen in effect that an outer edge 22 of dial 12 rests on the raised edge 21 of armature 13. As a variant, it is provided that edges 21 and 22 be secured to one another, on the one hand in order to enable the angular positioning of the dial and, on the other hand, to rigidify the case as a very compact assembly. This edges-to-edges attachment can be brought about for example by means of laser welding.

There will now be described a non-limiting embodiment of the wristwatch made according to the invention. For this, reference will be had to the plan view of FIG. 1 as well as to the cross-sections taken from such figure and explicitly to FIGS. 3, 4, 5 and 6.

Apart from the central wheel set 1 mounted for rotation on stud 16, itself fixed onto armature 13, there are also found other wheel sets making up movement 9 supported by the same armature, such wheel sets being rotatively mounted on studs. Rotatably mounted onto a stud 30 is found a wheel 31 driving wheel 32 fixed to the cannon pinion 17, itself driving the minutes hand 10. A pinion 33 fixed to wheel 31 drives wheel 19 with pipe 20 on which is fitted the hours hand 11. Stud 30 is fixed onto armature 13 as is the central stud 16, for example by riveting, screwing or welding. It can be imagined that stud 16, as well as the others moreover, is integrally obtained when moulding the back cover-caseband 7 with armature 13. The stud is then of plastic material around which the various wheel sets are mounted for rotation.

Figure 5:
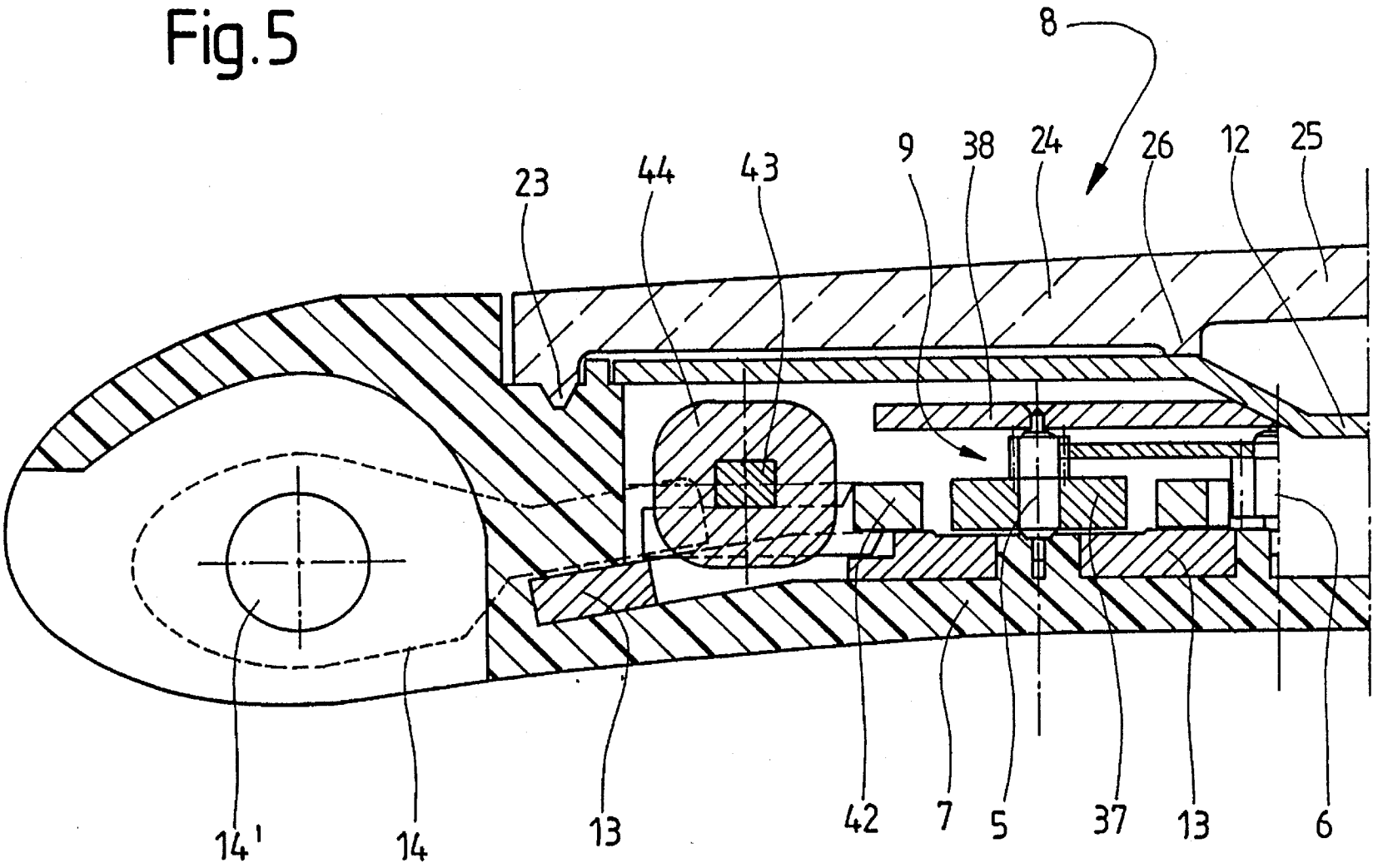
FIG. 5 is a cross-section along line V—V of FIG. 1.

Wheel 31 and pinion 33 form wheel set 2 which is driven by pinion 34 of a wheel set 6 which further includes a wheel 35, itself driven by pinion 36 of a motor wheel set 5 comprising a magnetized rotor 37. As is well shown on FIG. 4, wheel sets 5 and 6 include pivots turning in bearings formed on the one hand in the plastic material of the back cover 7 and, on the other hand, in a bridge 38. For example, concerning wheel set 6, the lower bearing is formed by a bore 39 formed in a bushing 40 filling up an opening 41 in armature 13. The bushing 40 is obtained during the injection of the back cover 7. The motor wheel set 5 is pivoted in the same manner as wheel set 6 by means of a bushing 51. As shown by FIG. 5, magnet 37 is surrounded by a stator 42 coupled to a core 43 on which a coil 44 is wound.

Figure 6:
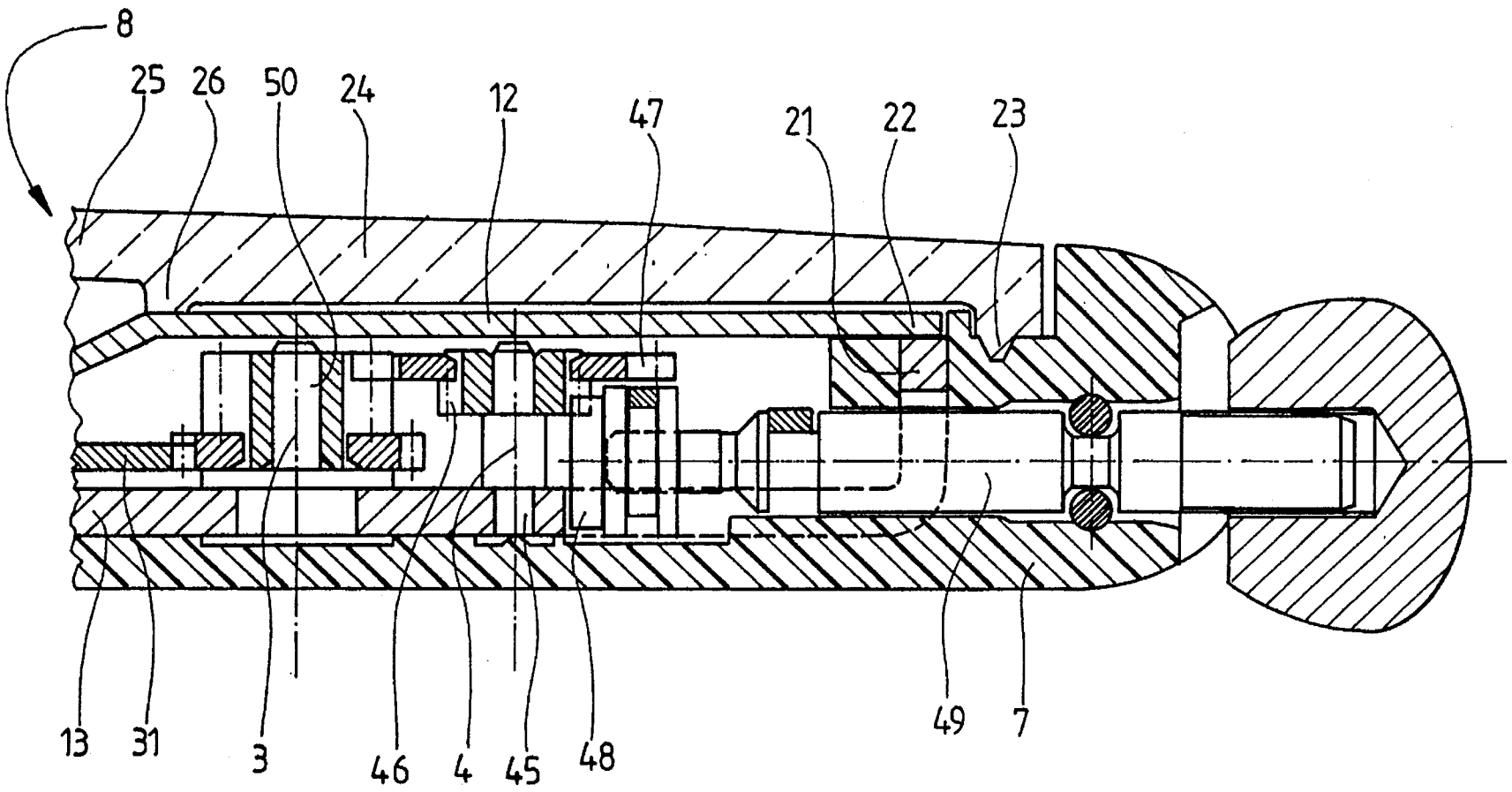
FIG. 6 is a cross-section along line VI—VI of FIG. 1.

Two other studs are fixed onto armature 13 as is seen on FIGS. 2 and 6. There is stud 45 on which turns wheel set 4 made up by a pinion 46 and a wheel 47. Pinion 46 is driven by the sliding pinion 48 when the stem 49 is drawn out for time setting of the watch. There is also stud 50 on which turns wheel set 3 which drives wheel 31 already cited. These two studs are directly fixed onto the armature in the same manner as are studs 30 and 50 already described.

Thus, to summarize what has already been said hereinabove, the armature or baseplate 13 is used in the embodiment taken as example to support not only the central wheel set 1, but other wheel sets, either by means of studs 30, 45, 50 or by means of bearings formed in the bushings 40 and 51 moulded into bores in the base plate 13.

In the wristwatch taken as example, the back cover-caseband 7 and crystal 8 are formed of heat-weldable thermoplastic materials. For example, caseband 7 is formed in a material chosen from the group comprising acryl butadiene styrene (ABS) and the crystal is formed of a transparent acrylic resin (PMMA). Means are provided for assembling crystal 8 and caseband 7, such means comprising a localized zone 23 formed by a mixture of said thermo-weldable materials between themselves (see FIGS. 4, 5 and 6). The interested reader will read with profit a description of this technique in the patent document EP-B-0 101 663 (U.S. Pat. No. 4,558,957). It is thus not necessary to expound here at greater length on this procedure.

However, since the watch which is sought to be produced here is ultra thin, that is to say, of a total thickness less than about 4 mm, it will concern the utilization of a very thin crystal as well, at least in the central zone 25 covering the hands 10 and 11, the peripheral zone 24 being thicker. In order to stiffen crystal 8, it is foreseen to fit it out with an annular reinforcing rib 26 as is seen in the cross-sections of FIGS. 3, 4, 5 and 6. As these figures show it, it is provided that such rib 26 bears on dial 12 which is in dished form. There is thus avoided contact between the crystal and the dial in the thick portion of such crystal which avoids scratching the dial. It will also be observed that in order to avoid sinking in of crystal 8, stud 16 is in contact with the lower face of said crystal according to an embodiment already described in this patent document CH-B-639 812.

To terminate, it will be noted that the dial in dished form pursues two purposes: initially that of rendering it stiffer and next that of arranging the thick components of the watch, namely the motor elements (FIGS. 4 and 5), the time setting mechanism (FIG. 6) and the power cell, the location 60 of which is seen on FIG. 2, under its peripheral zone. It is to be noted that a dial in dished form has been described in patent document CH-B-620 081.

Thus, the construction which has just been described enables the proposal of an ultra-thin wristwatch of plastic material, the rigidity of which is quite as good as if the case had been formed of metal.

What is claimed is:

1. An ultra-thin wristwatch including a back cover-caseband and a crystal formed in plastic material, a movement, hands surmounting a dial and a metallic reinforcing armature sunk into the back cover-caseband and serving, inter alia, as attachment points for a bracelet, said metallic reinforcing armature additionally serving as base plate onto which is secured at least one central stud around which pivots a cannon pinion carrying a minutes hand, a cannon wheel carrying an hours hand in turn pivoting on said cannon pinion.

2. A wristwatch as set forth in claim 1, in which the metallic armature bears horns located at 6 o'clock and 12 o'clock arranged to receive bars around which bracelet strands are linked and edges raised at a right angle at 3 o'clock and 9 o'clock on which the outer edge of the dial rests in part.

3. A wristwatch as set forth in claim 2, wherein the outer edge of the dial and the raised edges of the metallic armature are fastened to one another.

4. A wristwatch as set forth in claim 1, wherein the metallic armature additionally bears various wheel sets composing the movement.

5. A wristwatch as set forth in claim 1, wherein the back cover-caseband and the crystal are formed of heat weldable plastic materials, means being provided for assembling the crystal and the back cover-caseband, such means comprising a localized zone constituted by a mixture of the heat weldable materials among themselves.

6. A wristwatch as set forth in claim 1, wherein the crystal exhibits a peripheral zone thicker than a central zone covering the hands, there being an annular reinforcing rib at the origin of the peripheral zone arranged to bear on the dial.

* * * * *